US006263658B1

(12) United States Patent
Rosenwasser et al.

(10) Patent No.: US 6,263,658 B1
(45) Date of Patent: Jul. 24, 2001

(54) OVAL FACETED JEWELRY ROPE CHAIN

(75) Inventors: David Rosenwasser; Avram Moshe Rosenwasser, both of Demerest, NJ (US)

(73) Assignee: D&W Jewelry, Inc., New York, NY (US)

( * ) Notice: Subject to any disclaimer, the term of this patent is extended or adjusted under 35 U.S.C. 154(b) by 0 days.

(21) Appl. No.: 09/415,999

(22) Filed: Oct. 12, 1999

(51) Int. Cl.[7] ..... B21L 5/02
(52) U.S. Cl. ..... 59/80; 59/35.1
(58) Field of Search ..... 59/80, 82, 35.1

(56) References Cited

U.S. PATENT DOCUMENTS

| | | | | |
|---|---|---|---|---|
| 4,996,835 | * | 3/1991 | Rozenwasser | 59/80 |
| 5,125,225 | | 6/1992 | Strobel . | |
| 5,129,220 | | 7/1992 | Strobel . | |
| 5,285,625 | | 2/1994 | Ofrat et al. . | |
| 5,303,540 | * | 4/1994 | Rozenwasser | 59/80 |
| 5,353,584 | | 10/1994 | Strobel et al. . | |
| 5,408,820 | | 4/1995 | Strobel et al. . | |
| 5,437,149 | | 8/1995 | Strobel . | |
| 5,471,830 | | 12/1995 | Gonzales . | |
| 5,487,264 | | 1/1996 | Strobel . | |
| 5,526,639 | | 6/1996 | Gonzales . | |
| 5,531,065 | * | 7/1996 | Rozenwasser | 59/80 |
| 5,535,583 | | 7/1996 | Holzer et al. . | |
| 5,581,993 | | 12/1996 | Strobel . | |
| 5,653,100 | | 8/1997 | Dal Monte . | |
| 5,737,910 | | 4/1998 | Rozenwasser . | |
| 5,797,258 | | 8/1998 | Storbel et al. . | |
| 5,911,677 | * | 6/1999 | Kupelian | 59/35.1 |
| 5,966,922 | | 10/1999 | Cossio . | |

* cited by examiner

*Primary Examiner*—David Jones
(74) *Attorney, Agent, or Firm*—Helfgott & Karas, P C.

(57) ABSTRACT

A jewelry rope chain formed of a plurality of interconnected links. Each of the links has an exterior surface and the plurality of the links form the periphery of the chain. The exterior surface of the adjacent links of a pair of opposing groups of such links comprise a diamond cut curved surface. This forms opposing arcuate surfaces on the periphery of the chain. The exterior of the remaining opposing links intermediate of these two groups are uncut. As a result, the periphery of the chain is generally a slight oval in cross sectional configuration.

29 Claims, 4 Drawing Sheets

OVAL FACETED JEWELRY ROPE CHAIN

FIELD OF THE INVENTION

This invention relates to a jewelry chain and more particularly a faceted jewelry rope chain and a method for manufacturing such chain.

BACKGROUND OF THE INVENTION

Fine jewelry rope chain for necklaces and bracelets have been known for a long time. The traditional rope chain, constructed from intertwined links soldered to one another has been historically manufactured by hand. More recently, such manufacture has been achieved through machines.

Such rope chains are formed of individual links which are intertwined together. The links can be of numerous shapes and configurations. Traditionally, round links were utilized. However, other shapes of links can be utilized. By way of example, U.S. Pat. No. 4,996,835 to Rosenwasser describes an oval link but also shows other elongated shapes for the link. In addition, square links, and other numerous configurations have been used.

The links themselves are made up of either drawn wire or the link can be stamped from a flat sheet of material. When it is drawn from a wire, the wire can be either solid or hollow. The solid wire likewise can have numerous cross-sectional configurations. By way of example, U.S. Pat. No. 5,185,995 to Del Monte describes various cross-sectional configurations for solid wire. Other cross-sectional shapes have also been known.

Hollow wire can also be used to form the link. In such cases, the hollow wire forms a tube. In one form, the tube is a solid periphery which is called "seamless". However, more typically, the hollow tubular wire is provided with a seam along its inner periphery.

The individual links of whatever shape, formed of solid or hollow wire of also whatever shape, are intertwined in accordance with well known principles. U.S. Pat. No. 4,651,517 to Benhamu et al. describes a standard technique of interconnecting the individual links and soldering them to form the well known configuration of the jewelry rope chain. Such chain, when the links are intertwined, forms a double helix in configuration and appearance. The number and size of links that are utilized will determine the overall size of the peripheral configuration of the rope chain itself. In the aforementioned Benhamu U.S. Pat. No. 4,651,517 he discusses odd numbers of links. However, in Rosenwasser U.S. Pat. No. 4,934,135 there is also described the use of an even number of links.

The individual exterior surfaces of the links cumulatively form the peripheral surface of the rope chain. Accordingly, when the individual links are made of round or other arcuate shaped wire, the exterior appearance of the rope chain will show the individual undulations of the roundness of the individual wires. This is best shown in the schematic drawing of FIG. 1 which shows a typical classical prior art rope chain with a circular cross-sectional configuration made of found links each of solid wire with each of the wires being of a circular cross-section. If the cross-section of the wire used to form the links is square or rectangular, the individual undulations will be flatter but there still will appear individual undulations for each of the links making the periphery of the chain, as shown in FIG. 1.

In order to provide an improved finish, it has been well known in the prior art to form a highly polished surface along various sides of the rope chain. Typically this is achieved by means of a cut which is referred to as a "diamond cut", which forms a faceted surface along the links that are cut. This faceted surface is highly polished and gives a shine which reflects light with great intensity. Various techniques have been known to provide a faceted finish to the rope chain. Typically, a flat blade will be used to cut the individual links and provide the flat facets.

One method of providing such facets is to use the ice lathe cutting machine. In such machine, the rope chain, once it is completed, is wrapped around a drum. The rope chain is then frozen in place on the drum. A cutting tool is positioned in a carriage beneath the drum. The drum is rotated so that the chain rotates with respect to the tool. At the same time, the flat cutting tool moves longitudinally with respect to the carriage. The movement is coordinated so that a surface of the rope chain is cut and flattened to form a flat brilliant facet along that surface.

The rope chain is then removed and repositioned on the drum and again the cutting can proceed along another surface of the rope chain to provide another facet. The number of facets that are provided will depend upon the size of the blade, the positioning of the rope chain, and numerous other factors. Typically, four facets are formed around the periphery of the rope chain in the nature of a square, as shown in FIG. 2. However, additional facets can be formed as shown in FIG. 3 where eight facets have been shown. It is noted that the size of the facet on each link differs from the next.

The particular link configurations that have been shown in FIGS. 1–3 are links formed of solid wire configurations. In trying to provide such flat facets in a hollow wire configuration where the wire wall is rather thin, as the blade moves across the links, and as it cuts a surface portion of the link, it may actually cut through the link material making a perforation or hole instead of just a facet.

One method of achieving the flat facets on a hollow rope chain is described in Strobel U.S. Pat. No. 5,129,220. Such method involves flattening the hollow rope chain by moving one outer wall closer to an inner wall of the link material thereby producing the effect of a flattened portion.

In addition to the four, six and eight sided facets heretofore described, other faceting configurations have been provided. U.S. Pat. No. 5,285,625 describes what is referred to as a "spiral facet". In that case, a technique is used to cut all of the links entirely around the peripheral of the chain and provide a substantially similar flattened surface on every consecutive link. The result is shown in FIG. 4. It should be noted that in this case there are again flattened surfaces along each link. However, every link is faceted around the entire periphery as compared to FIG. 2 or 3 where only certain sides were faceted or groups were faceted, and the extent of the face is essentially the same as all links.

In all of these prior art methods, the diamond cut or facet formed on the exterior of the link provided a flattened surface. However, there is yet another type of faceting that has been described in the prior art by Gonzales U.S. Pat. Nos. 5,526,639 and 5,471,830. Such facets are referred to as "round facets". Again, similar to the spiral facet of FIG. 4, this configuration provides a facet on the exterior of every link around the entire periphery of the chain with each facet being essentially the same. However, in this case, rather than provide flat facets as in FIG. 4, it provides curved facets as shown in FIG. 5. Thus, the entire periphery of the chain is faceted with each facet being curved so that the entire periphery provides a continuously curved surface which has been diamond cut.

It should be appreciated, that especially in the spiral diamond cut of FIG. 4 and the round diamond cut of FIG. 6, not a great amount of the exterior of the links will be cut. As such, rather than a deep diamond cut only a limited amount is removed providing almost a reflective finish to the jewelry rope chain rather than a deep cut. As such, such reflective finishes removing only a slight amount of the periphery can even be used for a hollow rope chain, not only solid rope chain. It should be appreciated that herein the use of the term facet covers all such cuts including the forming of the reflective finish.

The particular method described by Gonzales in achieving his round facets is again to use the ice lathe method. However, in this case he uses a curved or arcuate blade on the cutting tool which cuts an arcuate section about the periphery of the rope chain as the rope chain, wound on the drum, is rotated with respect to the longitudinal movement of the cutting tool. After each cut, the chain is removed, repositioned on the drum, and again rotated with respect to the longitudinal movement of the curved blade to cut another section off the exterior periphery of the rope chain.

SUMMARY OF THE INVENTION

It is accordingly an object of the present invention to provide a new type of faceted rope chain which produces a unique exterior appearance.

A further object of the present invention is to provide a faceted rope chain which can be applied to solid or hollow type rope chains.

Yet a further object of the present invention is to provide a new method for faceting the exterior of a rope chain.

Briefly, in accordance with the present invention, there is provided a jewelry rope chain which is formed of a plurality of interconnected links. Each of the links includes an exterior surface with the plurality of these interconnected links forming the overall periphery of the chain. The exterior surfaces of the adjacent links of each of an opposing group of links comprise a diamond cut curved surface thereby forming opposing arcuate surfaces on the periphery of the chain. The exterior surface of the remaining opposing links which are intermediate to these opposing group comprise an uncut surface. As a result, the overall periphery of the chain is provided with a slight oval configuration and cross section.

The invention further describes a method of providing a reflective finish to a jewelry rope chain, wherein the rope chain has a plurality of interconnected links which form an initial periphery having a cross section of a given radius. The method includes the steps of providing a cutting assembly forming an arcuate cutting surface and having a radius greater than the given radius of the periphery of the chain. The cutting assembly is then positioned in engagement with the chain. The cutting assembly is then moved relative to the chain in order to simultaneously remove a portion of the periphery of some of the links of the chain and form a slight oval contour to the chain.

BRIEF DESCRIPTION OF THE DRAWINGS

The present invention will be more fully understood and appreciated from the following detailed description taken in conjunction with the drawings.

DETAILED DESCRIPTION OF THE INVENTION

Figure 6:
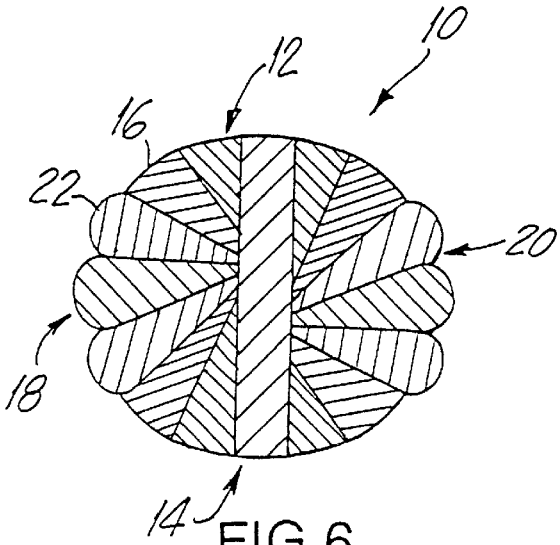
FIG. 6 is a cross sectional view of a rope chain made from round wire links having a preferred finish of the present invention.

As heretofore explained, prior methods of providing facets, or reflective surfaces on the exterior of a jewelry rope chain involved either the use of flat facets wherein the exterior of the link surface was flattened, or the use of round facets around the entire periphery of the rope chain, wherein the periphery of each link formed as part of the round periphery of the chain. With reference now to FIG. 6, the present invention covers a jewelry rope chain 10 whose cross sectional configuration is schematically shown. The jewelry rope chain is shown as of having an upper and lower section 12, 14, and the exterior of certain links has been diamond cut 16. The diamond cut forms a highly reflective surface which is heretofore referred to as a facet. It is noted that in the sections 12 and 14, each facet is rounded rather than flattened. Furthermore, the adjacent facets in the sections 12, 14, respectively form an arcuate surface of a slight oval configuration. Such facets are interconnected and appear continuous when the adjacent links of these sections are disposed in contact.

It will be noted that the intermediate links on opposing sides 18, 20 remain unfaceted so that their exterior retains the undulation 22 on the original link itself.

As a result of the facets, the overall configuration of the rope chain, in cross section, provides a slight oval configuration, as a result, this is referred to an oval faceted rope chain. However, the facets do not extend around the entire periphery of the rope chain, but only the opposing sections 12, 14 have been faceted. However, of those links that have been faceted, the facet is an arcuate facet, not a flat facet.

Figure 7:
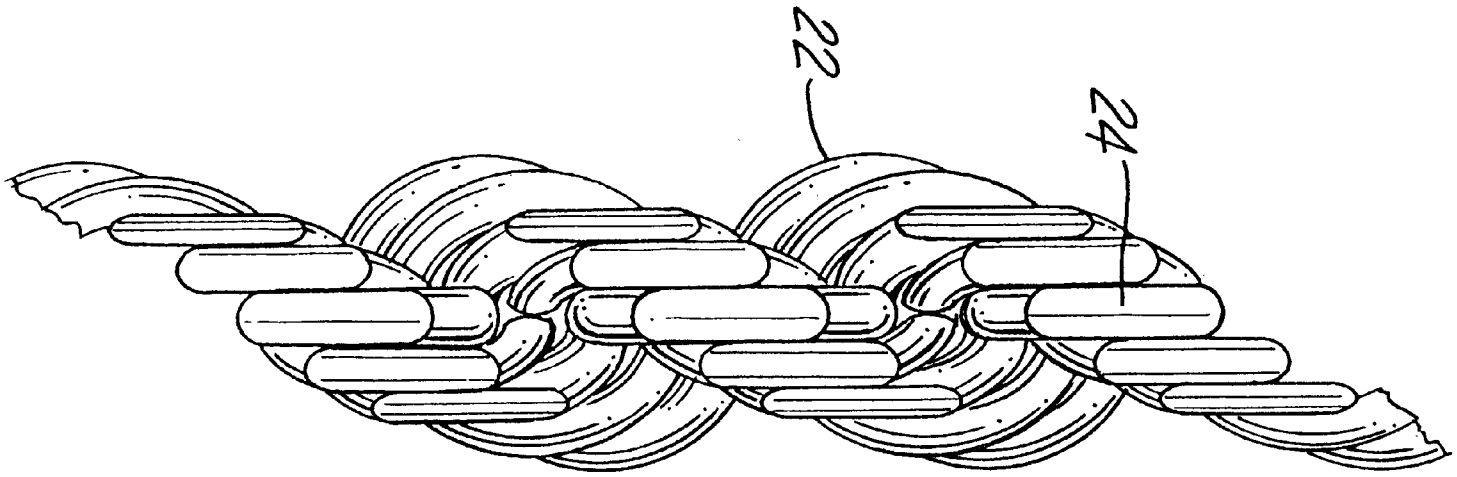
FIG. 7 is a perspective view of a portion of a rope chain of the present invention.

Referring to FIG. 7, the chain itself can be noted as providing individual links 22. Some of the links, adjacent to each other have been provided with a facet 24. These facets are arcuate and are adjacent to each other. However, those portions on either side of the groups of faceted links are unfaceted and remain with their original undulated configuration.

Although FIG. 6 showed the jewelry rope chain as being formed of solid links, because the amount removed by the diamond cut is minimal, so as to provide a highly reflective finish, this same configuration can be applied to hollow rope chain as well.

Figure 8:
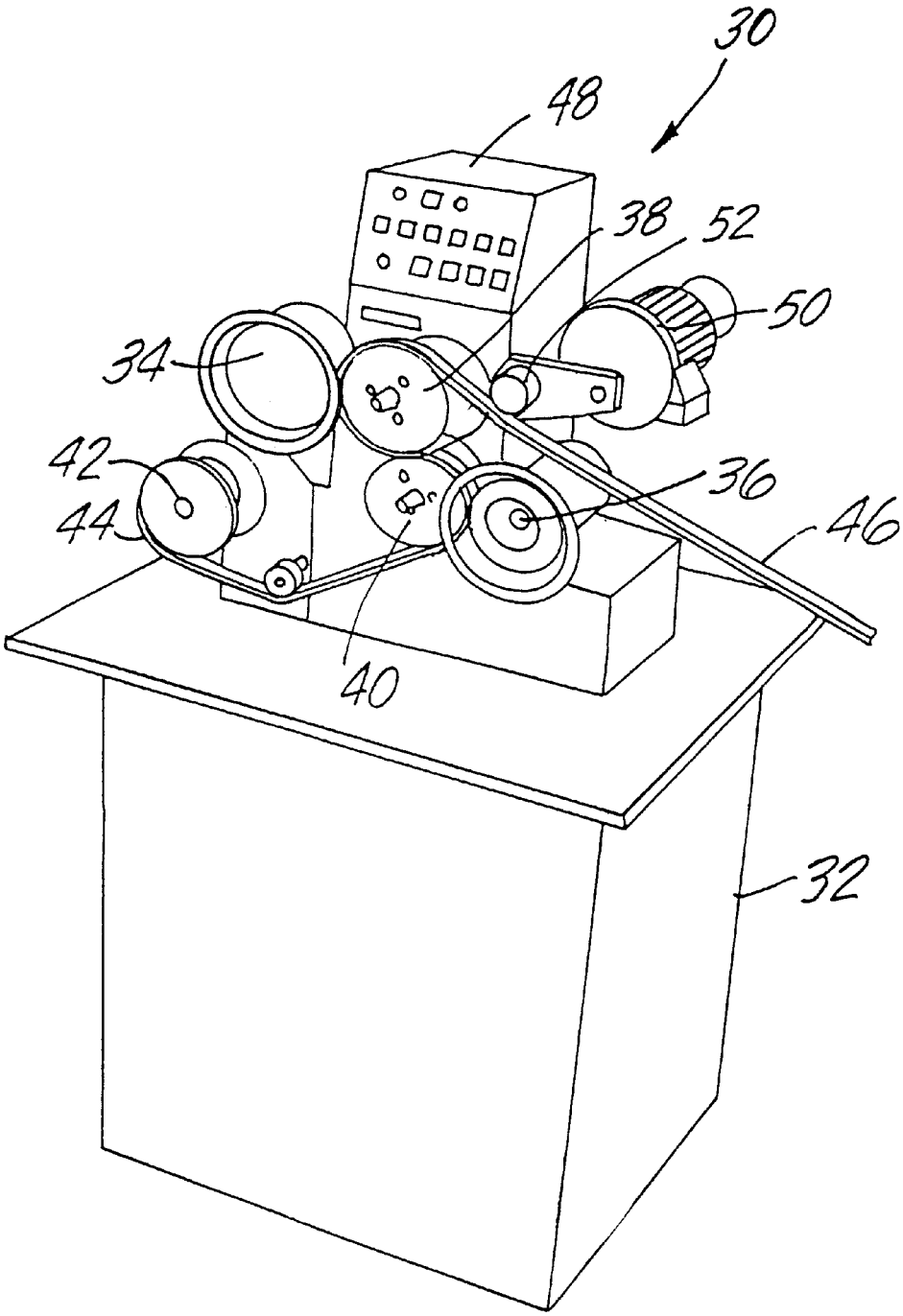
FIG. 8 is a schematic view of a cutting tool machine used with a method of the present invention.

One method of providing the present oval faceted configuration is to use well known diamond milling machine of the type schematically shown in FIG. 8. Such machine shown generally at 30 is mounted on a table 32 for support. The machine includes a pair of opposing cutting tool assemblies 34, 36. The individual cutting tools are positioned on these tool assemblies as will hereinafter be explained. Opposing drums 38, 40 are also provided. Grooves are formed in the drums for receiving a chain. A spool of chain wire 42 can be mounted on the system. The chain wire 44 fed out from the spool 42 and fed around initially the grooved drum 40. From there is passes around the grooved drum 38 and then exits at 46. It should be appreciated, that by passing around drum 40 one exterior surface of the chain is exposed and as it continues around drum 38, the other diametrically opposed exterior surface of the chain is exposed. Thus, in one pass of the chain across the two drums 38 and 40, both exterior opposing surfaces of the drum can be operated upon.

Cutting tool assembly 36 interacts with the chain when it is on drum 40. Cutting tool assembly 34 interacts with the chain when it is in the groove of the drum 38.

The two drums 38, 40 rotate at a relatively slow speed of up to about six millimeters per minute. On the other hand, the blade assemblies 36, 38 rotate at anywhere between 6800–36000 revolutions per minute. However, other values can be used as are well known.

The machine shown in FIG. 8 also includes a controller 48, a drive motor 50 and drive wheels 52, all of which is conventional.

Figure 9:
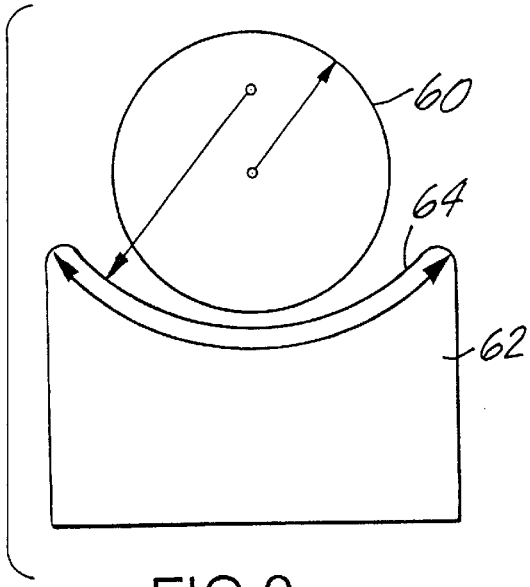
FIG. 9 is a schematic view of the operation of the cutting tool with relationship to the periphery of the rope chain.
Figure 10:
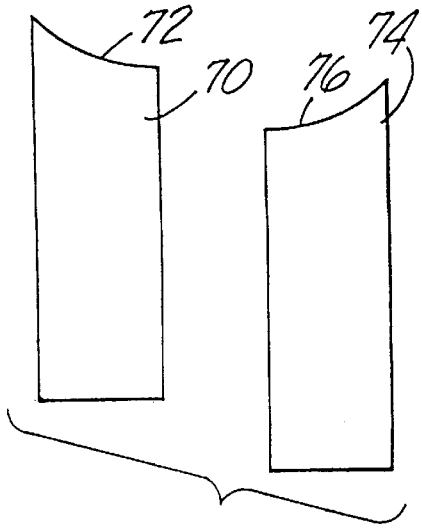
FIG. 10 is a composite view of a cutting tool assembly.
Figure 11:
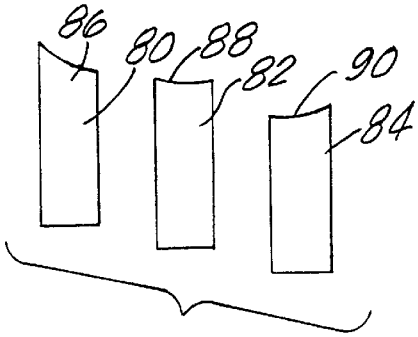
FIG. 11 is a schematic of another embodiment of the cutting tool assembly.

With reference to FIG. 9, there is schematically shown a jewelry rope chain 60 which is formed of intertwined links as is well known in the art. The rope chain is shown as having a radius R1. By way of example, a standard 3 millimeter chain would have a radius of 1.5 millimeters.

Adjacent to the claim is shown a cutting tool 62 having a cutting surface 64. The cutting surface is shown as a single unitary arcuate continuous cutting surface. However, the radius of the cutting surface is shown as R2 where R2 is greater than R1. By way of example, for the 3 millimeter chain have a radius 1.5, the radius of the cutting tool might be 1.60.

It should also be noted that the extent of coverage of the cutting blades with respect to the chain is less than 180° of its periphery. Such length of coverage is shown by the arcuate length L. That length L will always extend arcuately around the original periphery of the chain less than 180°. Preferably, approximately 140° has been found as useful.

Figure 12:
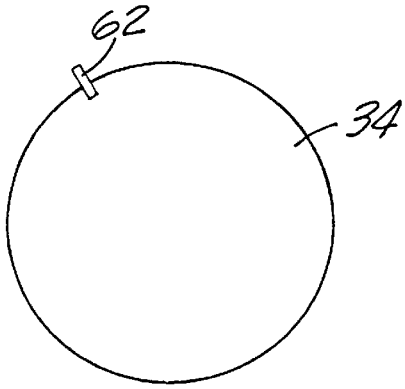
FIGS. 12–14 are embodiments a schematic showing the placement of the cutting tool blades on the cutting tool assembly.

As shown in FIG. 9, the cutting blade can be of a single arcuate configuration. As such, that blade would be positioned along one location of the cutting wheel 34, as shown in FIG. 12. Similarly, another substantially identical cutting blade would be placed in position on cutting wheel 36. Thus, as the cutting wheel 36 rotates at a high speed with respect to the chain and as the chain moves relatively slowly around drum 40, the cutting tool 62 will diamond cut a group of links which is adjacent to each other and provide an effective oval cut along the chain section it engages by faceting the exterior surfaces of the links that it interacts with. The amount that it cuts is minimal almost providing nothing more than a reflective finish but is still referred to as a facet. As a result, it can work on both solid and hollow rope chain.

As the rope chain continues around the next drum 38, the other cutting tool on drum 34 will now do the same thing on the opposite side of the chain. However, the links intermediate these two opposite portions that are faceted will remain unaffected so that they will continue with their exterior undulations being uncut. The result will provide a cross sectional configuration as was heretofore shown in FIGS. 6 and 7.

Figure 13:
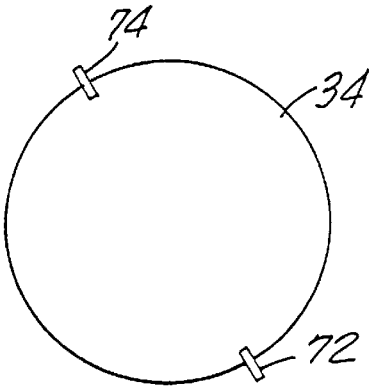

Instead of providing a single cutting blade as shown in FIG. 9, the cutting tool assembly can be split into two, including a first cutting tool blade 70 with a cutting surface 72 and a second cutting tool blade 74 with a cutting surface 76. Again, assuming a total arcuate angle of 140° is to be cut around the periphery of the chain, each of the cutting tools 70, 76, would provide approximately 70° of cutting surface around the periphery of the chain. Of course, the radius of the two arcuate surfaces 72, 76 would again be larger than the radius of the chain. When using two cutting tools, as shown in FIG. 13, they would be placed at opposing sides of the cutting wheel 34.

Figure 1:
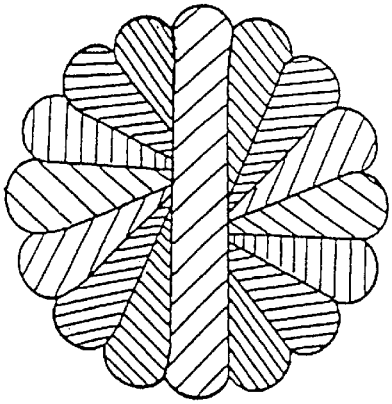
(PRIOR ART) FIG.1
FIG. 1 is a cross sectional view of a conventional rope chain of the prior art made with round links.
Figure 2:
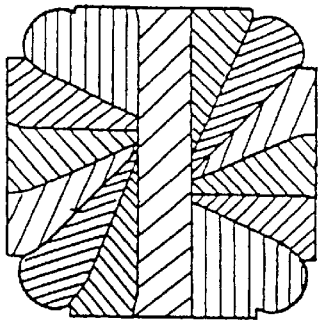
(PRIOR ART) FIG.2
FIG. 2 is a cross sectional view of a prior art rope chain with a square facet.
Figure 3:
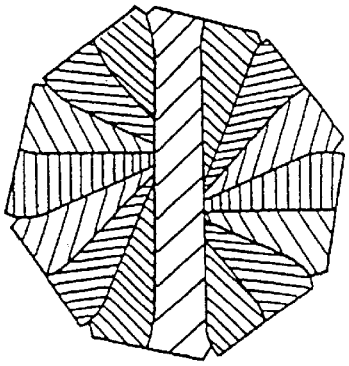
(PRIOR ART) FIG.3
FIG. 3 is a cross sectional view of a prior art rope chain having eight facets diamond cut therearound.
Figure 4:
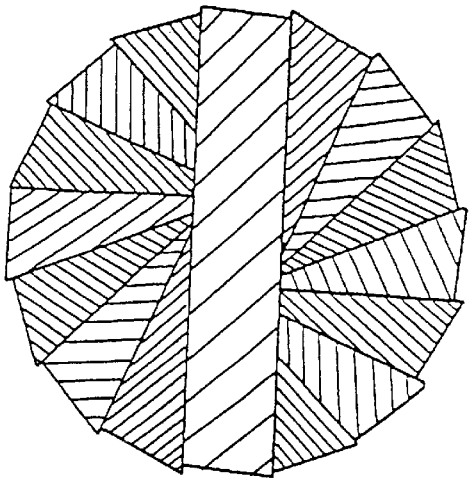
(PRIOR ART) FIG.4
FIG. 4 is a cross sectional view of a prior art rope chain showing a spiral facet.
Figure 5:
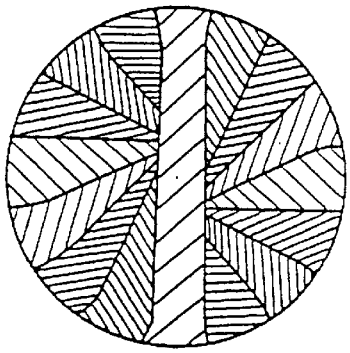
(PRIOR ART) FIG.5
FIG. 5 is a cross sectional view of a prior art rope chain showing a round facet.
Figure 14:
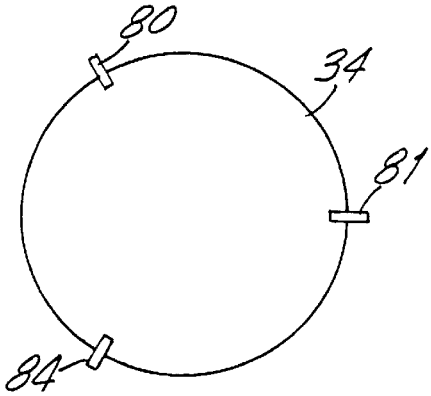

As shown in FIG. 3, it will be noted that the cutting tools can be formed into three sections 80, 82, 84 each with respective cutting surfaces 86, 88 and 90. Hereagain the angles would be divided up so that cumulatively they come up to the same 140° or the like. As shown in FIG. 14, these would then be placed peripherally around the cutting wheels 34 and 36 so that as the cutting wheels make a single rotation it has the three blades engaging sequentially the surfaces of the chain cutting different arcuate portions along the surface of the chain.

It should be appreciated that each individual blade section could be duplicated to cut different depths if desired. For example, in FIG. 12 two such blades 62 could be used on one cutting wheel with one sticking out further than the other so that one would cut deeper than the other. In this way, the depth of the cut can be adjusted either by adjusting one blade or by using two blades. This can also be repeated for each of the other configurations shown in FIGS. 13 and 14.

It would be appreciated to persons skilled in the art that the scope of the present invention is not limited by what has been shown and described above, merely by way of example. The scope of the present invention is limited rather solely by the claims which follow.

What is claimed is:

1. A jewelry rope chain comprising:

a plurality of interconnected links defining opposing groups of links when said chain is viewed cross-sectionally;

each of said links comprising an exterior surface, said exterior surfaces of said plurality of interconnected links forming a periphery of the chain;

wherein the exterior surfaces of adjacent links of some of said opposing groups of links comprise a diamond cut curved surface forming arcuate surfaces of non-uniform width on the periphery of said chain, and the exterior surfaces of the remaining links intermediate said some of said opposing groups comprise an uncut surface, and wherein the periphery of the chain is generally slightly oval in cross-section.

2. A jewelry chain as in claim 1, wherein said oval cross-section comprises a major and a minor diameter, and said diamond cut surfaces define a faceted chain in the direction of said major diameter, and the uncut surfaces define an unfaceted chain the direction of said minor diameter.

3. A jewelry chain as in claim 2, wherein said faceted portions of the chain each extend less than 180° about the periphery of said chain.

4. A jewelry chain as in claim 3, wherein said faceted portions of the chain each extend about 140° around the periphery of said chain.

5. A jewelry chain as in claim 1, wherein said diamond cut curved surfaces are continuous and said uncut surface of said remaining links are undulated.

6. A jewelry chain as in claim 1, wherein said links are solid.

7. A jewelry chain as in claim 1, wherein said links are hollow.

8. A jewelry chain as in claim 1, wherein the outward appearance of the chain is in the form of a double helix.

9. A jewelry chain as in claim 5, wherein the diamond cut surfaces on adjacent links are different.

10. A jewelry rope chain comprising:

a plurality of links having exterior surfaces and intertwined to fit tightly one against the other and form an outward appearance of a double helix configuration, the exterior surface of said links defining the periphery of said chain, said periphery being slightly oval in cross sectional configuration, said cross section configuration having elongated portions and narrow portions, the elongated portions of said oval configuration displaying a reflective finished surface and the narrow portions of said oval configuration displaying an unreflective finished surface.

11. A jewelry rope chain as in claim 10, wherein said reflective finished surface comprises a faceted surface and said unreflective finished surface comprises an unfaceted surface.

12. A jewelry rope chain as in claim 10, wherein the faceted surfaces are curved.

13. A jewelry rope chain as in claim 10, wherein the unfaceted surfaces form undulations.

14. A jewelry rope chain as in claim 10, wherein the faceted surface extends about an arcuate portion of less than 180°.

15. A jewelry rope chain as in claim 14, wherein the faceted surface extends about an arcuate portion of about 140°.

16. A jewelry rope chain as in claim 10, wherein said links are solid.

17. A jewelry rope chain as in claim 10, wherein said links are hollow.

18. A jewelry rope chain as in claim 16, wherein the faceted portions on adjacent links are different.

19. A method of providing a reflective finish to a jewelry rope chain comprising a plurality of interconnected links, each having a peripheral surface, which form an initial periphery having a cross section of a given radius, comprising the steps of:

providing a cutting assembly forming an arcuate cutting surface having a radius greater than said given radius;

positioning said cutting assembly in engagement with said chain;

moving said cutting assembly relative to said chain thereby simultaneously removing non-uniform portions of the peripheral surface of some, but not all of said links of said chain such that said reflective finish along a final periphery of said chain is defined by a slight oval contour along some portions of the final periphery and undulations along other portions of the final periphery.

20. A method of providing a reflective finish to a jewelry rope chain as in claim 19, wherein said arcuate cutting surface extends less than 180° around said initial periphery.

21. A method of providing a reflective finish to a jewelry rope chain as in claim 20, wherein said arcuate cutting surface extends about 140° around said initial periphery.

22. A method of providing a reflective finish to a jewelry rope chain as in claim 19, wherein said cutting assembly comprise a single cutting tool having a continuously curved concave cutting edge which extends less than 180° around said initial periphery.

23. A method of providing a reflective finish to a jewelry rope chain as in claim 19, wherein said cutting assembly comprises at least two cutting tool sections, said sections sequentially extending around said initial periphery to continuously extend less than 180° around said initial periphery.

24. A method of providing a reflective finish to a jewelry rope chain as in claim 23, wherein said cutting tool sections are peripherally spaced from each other about a cutting wheel.

25. A method of providing a reflective finish to a jewelry rope chain as in claim 19, wherein the reflective surface on adjacent cut links are different.

26. A method of providing a reflective finish to a jewelry rope chain comprising a plurality of interconnected links which form an initial periphery having a cross section of a given radius, comprising the steps of:

providing a cutting assembly forming an arcuate cutting surface having a radius greater than said given radius;

positioning said cutting assembly in engagement with said chain;

moving said cutting assembly relative to said chain thereby simultaneously removing a portion of the peripheral surface of some of said links of said chain and forming a slight oval contour to the chain, and providing two such cutting assemblies each positioned to engage an opposite surface of said chain, and moving both said cutting assemblies relative to said chain thereby removing the peripheral surface of some links on opposing sides of the chain.

27. A method of providing a reflective finish to a jewelry rope chain as in claim 26, wherein the links intermediate said opposing sides remain uncut.

28. A method of providing a reflective finish to a jewelry rope chain comprising a plurality of interconnected links which form an initial periphery having a cross section of a given radius, comprising the steps of:

providing a cutting assembly forming an arcuate cutting surface having a radius greater than said given radius;

positioning said cutting assembly in engagement with said chain;

moving said cutting assembly relative to said chain thereby simultaneously removing a portion of the peripheral surface of some of said links of said chain and forming a slight oval contour to the chain, wherein said chain moves longitudinally with respect to the cutting assembly and the cutting assembly rotates with respect to the chain.

29. A method of providing a reflective finish to a jewelry rope chain as in claim 28, wherein the movement of the chain is slower than the movement of the cutting assembly.

* * * * *